United States Patent [19]

Davis

[11] 4,387,708

[45] Jun. 14, 1983

[54] PNEUMATIC PERCUSSOR

[76] Inventor: James E. P. Davis, 2510-8 Arizona Ave., Santa Monica, Calif. 90404

[21] Appl. No.: 264,970

[22] Filed: May 18, 1981

[51] Int. Cl.[3] ..... A61H 1/00

[52] U.S. Cl. ..... 128/55; 128/40; 128/64; 91/50

[58] Field of Search ..... 128/53, 55, 64, 38, 128/39, 40, 24, 37, 47, 50; 91/50; 251/82, 83

[56] References Cited

U.S. PATENT DOCUMENTS

| | | | |
|---|---|---|---|
| 2,319,608 | 5/1943 | Kraut | 91/50 |
| 2,980,076 | 1/1961 | Machlan | 91/50 |
| 3,230,839 | 1/1966 | Gaston | 91/50 |

FOREIGN PATENT DOCUMENTS

| | | | |
|---|---|---|---|
| 1292978 | 4/1969 | Fed. Rep. of Germany | 251/83 |
| 146395 | 4/1931 | Switzerland | 128/53 |
| 511441 | 9/1976 | U.S.S.R. | 91/50 |
| 750152 | 7/1980 | U.S.S.R. | 91/50 |

*Primary Examiner*—Richard J. Apley
*Assistant Examiner*—David J. Brown
*Attorney, Agent, or Firm*—Roger A. Marrs

[57] ABSTRACT

A pneumatic percussor is disclosed herein for therapeutic purposes such as to loosen and mobilize bronchial secretions in humans which provides an applicator having a cylindrical body with a central partition incorporating a movable poppet valve. A front diaphragm is movably carried in the body immediately ahead of the partition so as to define a pressure chamber therebetween. A relief chamber is defined on the opposite side of the partition as established by a second or rear diaphragm which also carries the poppet valve. A hammer is secured to the front diaphragm so as to follow its movement and an application pad is fixed to the hammer. Biasing springs normally maintain the poppet valve closed and the front diaphragm against an impact seal carried on the partition. A compressed gas is introduced into the pressure chamber to move the front diaphragm including the hammer and the pad while build-up of pressure operates the rear diaphragm to open the poppet valve to exhaust the relief chamber to atmosphere whereby the front diaphragm, hammer and pad return stroke to their initial position. Guides coaxially support the pad, hammer and front diaphragm as well as the poppet valve and the second or rear diaphragm.

7 Claims, 2 Drawing Figures

FIG. 1
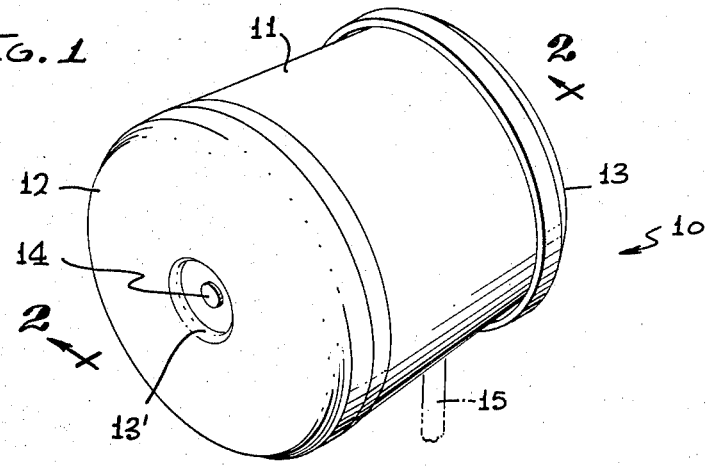
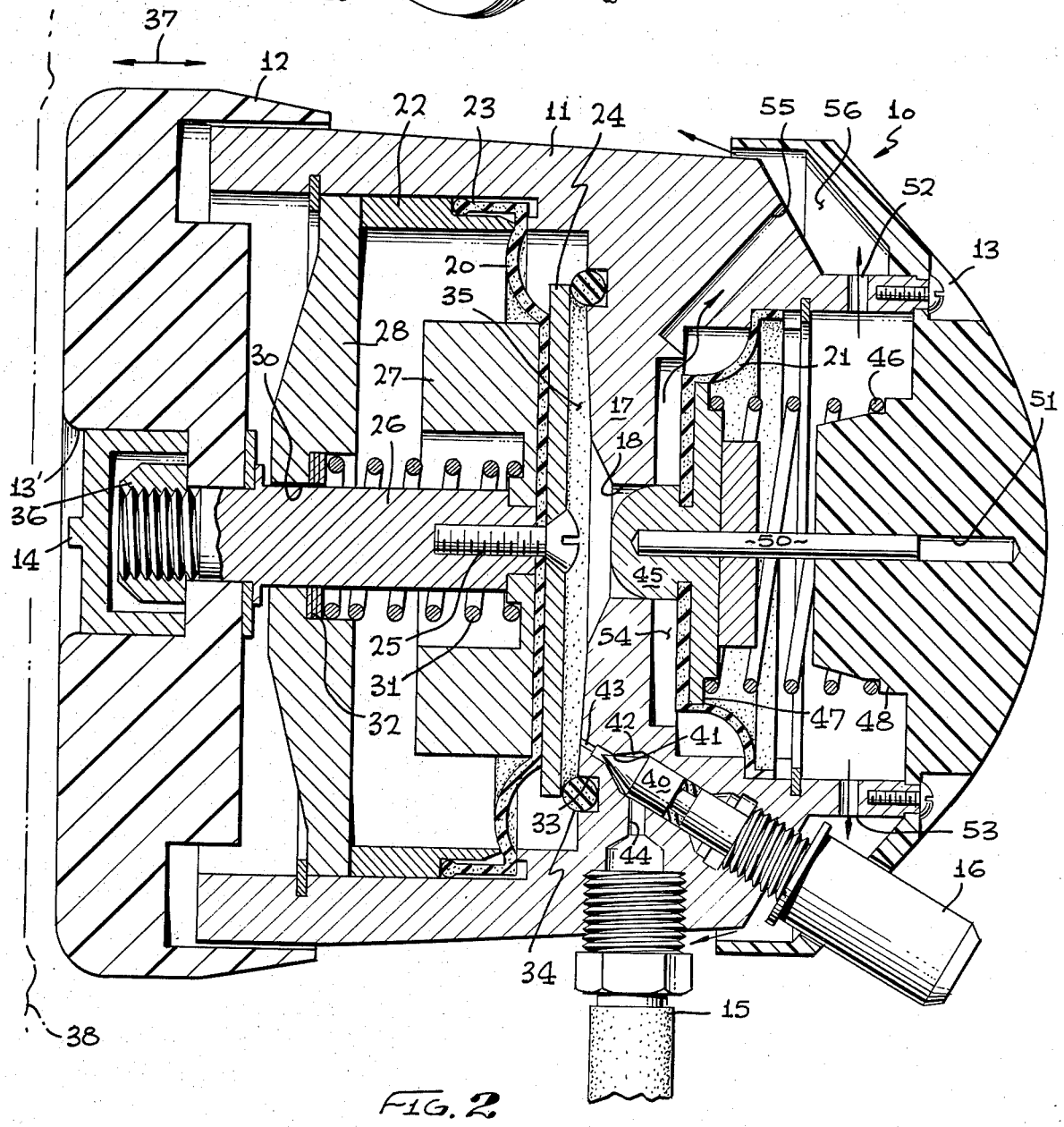
FIG. 2

PNEUMATIC PERCUSSOR

BACKGROUND OF THE INVENTION

1. Field of the Invention

This invention relates to medical devices in which medical benefits are achieved through application of vibratory force to the human body. The invention can be used to loosen and to mobilize bronchial secretions in the lungs of humans and in this respect has relationship to devices or techniques which rely upon engagement of the chest or back of an individual to impart a force to the chest cavity to bring about the loosening of bronchial secretions in the lungs. Providing such loosening of bronchial secretions is beneficial to patients suffering from such respiratory ailments as emphysema, asthma, cystic fibrosis, tuberculosis, post operative congestion problems, and other congestive respiratory problems.

2. Brief Description of the Prior Art

In the prior art, various methods and devices have been used for these purposes. One method used to loosen bronchial secretions has been by hand message and percussion. In this technique a nurse or other attendant uses her hands to strike the back or chest of the patient to cause a loosening of the secretions. This can be painful and can even result in broken ribs or severe bruises, especially in infants and in older patients.

Percussion type vibrations using weights or hammers have also been used to loosen bronchial secretions. In their use, the vibrator is placed upon the back or the chest of the patient and the vibration unit is operated so that a vibrating member such as the weight or hammer is forced in towards the patient then out away from him repetitiously. Another type of vibration unit that is used is the oscillation type, in which the vibrating member rotates about an axis perpendicular to the chest or back of the patient when it is applied. This type of unit provides a massaging circular oscillation force to the body. These devices employ heavy, free hammers which are difficult to use and heavy blows may break patients' ribs.

Therefore, a long standing need has existed to provide a cycling device which employs an internal hammer to create an internal impact whereby this internal impact transmits a percussive blow more safely than can be had with a free moving hammer or weight.

SUMMARY OF THE INVENTION

Accordingly, the above problems and difficulties are obviated by the present invention which provides a novel pneumatic percussor for therapeutic purposes which provides a cylindrical body having front and rear diaphragms coaxially disposed in the body in spaced relationship. A body partition is disposed between the diaphragms so as to define a pressure chamber and a relief or vented chamber between its opposite sides and an associated or respective diaphragm. Valve means are operably carried on the rear diaphragm and function in cooperation with the body partition to relieve excessive pressure in the pressure chamber via the relief chamber by venting or exhausting the pressure to atmosphere. A weighted applicator pad is secured to the front diaphragm for imparting oscillatory impact force to a user in response to cyclic pressuring and pressure relief occuring in the pressure chamber. The rear diaphragm is normally biased so as to reduce the area of the pressure chamber and to close the relief valve means while guide means are employed to movably support the applicator pad and the diaphragm.

Therefore, it is among the primary objects of the present invention to provide a novel pneumatic percussion vibrator which can be employed for the treatment of obstructive pulmonary disorders in patients of various size and ages.

Still another object of the present invention is to provide a novel pneumatic percussion vibrator which is employed for imparting oscillatory impacting force in response to cyclic pressuring and pressure relieving of an active pressurized chamber.

Still a further object of the present invention is to provide a novel percussor device having an oscillating impact applicator which is operated by pneumatic cycling.

Still a further object of the present invention is to provide a novel pneumatic percussor apparatus for imparting an oscillatory impacting force to the body of the user which employes a relief valve cycling mechanism which operates in resonse to a change in volume or area or a pressure chamber so as to create the oscillatory impacting force.

Yet a further object of the present invention is to provide a novel pneumatic percussion apparatus for therapeutic purposes which employs plastic covers so that the apparatus easily slides across a patient's chest or body while transmitting the percussive impacts.

BRIEF DESCRIPTION OF THE DRAWINGS

The features of the present invention which are believed to be novel are set forth with particularity in the appended claims. The present invention, both as to its organization and manner of operation, together with further objects and advantages thereof, may best be understood by reference to the following description, taken in connection with the accompanying drawings in which:

FIG. 1 is a perspective view of the novel pneumatic percussive apparatus incorporating the present invention as may be readily employed for therapeutic purposes; and FIG. 2 is an enlarged longitudinal cross sectional view of the pneumatic percussive apparatus shown in FIG. 1 as taken in the direction of arrows 2—2 thereof.

DESCRIPTION OF PREFERRED EMBODIMENT

Referring to FIG. 1, the novel pneumatic percussive apparatus of the present invention is shown in the general direction of arrow 10 which includes a cylindrical body 11 having a front cover or impact applicator 12 and a rear cover indicated by numeral 13. The front cover includes an opening 13' which exposes a cap 14. The front cover or applicator pad 12 oscillates in a back and forth movement with respect to the cylindrical body 11 while the user's hand is cupped over the rear cover 13. The device is manipulated by the user's hand so that the applicator pad 12 may be held against a selected part of the body. A compressed gas, such as pressurized air, is introduced to the apparatus 10 by means of suitable conduit 15 and the applied pressure of the gas is adjusted by means of a control knob 16.

Referring now in detail to FIG. 2, it can be seen that the cylindrical body 11 includes a central partition identified by numeral 17 which is provided with a central opening or hole 18. The partition 17 separates a front and a rear diaphragm indicated in general by the numerals 20 and 21 respectively. The front diaphragm 20 is held in place to the internal bore of the cylinder body 11 by means of a diaphragm spacer 22 which anchors the flanged circular end 23 of the diaphragm to the body. The diaphragm further includes a front plate 24 which rigidizes the central portion of the diaphragm and by means of a mounting screw 25, the plate and diaphragm are secured to a central shaft 26. Also, it can be seen that a weighted hammer 27 is carried against the side of the diaphragm 20 opposite from the side engaging with the front plate 24. By means of the hammer, substantial weight is given to the diaphragm. A guide or centering plate 28 is carried in the bore of the body 11 and includes a central opening 30 for receiving the length of shaft 26. A compressed spring 31 has its opposite ends placed against shims 32 resting in a recess formed in the guide or centering plate 28 and its opposite end bearing against the under side of the hammer 27 so that the diaphragm 20 is normally biased in the direction of the partition 17. The partition 17 includes an annular recess 33 for mounting a resilient impact "O" ring 34 against which the peripheral edge of the front plate 24 bears. In this latter position, a pressure chamber is defined between the diaphragm 20 and the opposing face or surface of the partition 17. The pressure chamber is identified in general by the numeral 35.

The extreme end of the centering shaft 26 is loosely attached to the pad 12 by means of a nut 36 to allow rotation and facilitate sliding. Cover 14 conceals the nut 36 from view. Therefore, it can be seen that the pad 12 moves back and forth as indicated by arrows 37 as the shaft 26 moves in response to flexing of the diaphragm 20. The weight of the hammer 27 is added to the impact of the pad 12 against the skin of the body which is indicated by the numeral 38. The movement of the pad in one direction is terminated by engagement of the peripheral edge of plate 24 with the "O" ring 34 and movement is terminated in the opposite direction by pressure by either the spring 31 bottoming out or, usually, when the rear valve relieves and stops forward travel before the spring goes solid. Pressure is introduced to the chamber via a needle valve 40 having its conical end selectively engageable with a corresponding seat 41 in a passageway 42 interconnecting input passageways 43 and 44 respectively. Passageway 44 is in fluid communication with conduit 15 which is suitably attached to a supply of compressed gas such as pressurized air. In this manner, the compressed gas is introduced into the pressure chamber 35 as metered by the needle valve 40. The valve 40 is under finger control by means of knob 16 which is exposed externally of the rear cover 13.

With respect to relief of pressure in the pressure chamber 35 there is provided a poppet valve taking the form of rounded member 45 which is seated in the partition central opening 18. The rounded member or portion 45 is carried on the rear diaphragm 21 and the poppet valve is normally closed as biased by the expansion spring 46 which bears at one end against a plate 47 carried on the backside of rear diaphragm 21 and at its other end against a shoulder 48 carried on the inside of the rear cover 13. A guide is provided for the moving poppet valve which takes the form rod 50 which is permanently pressed into portion 45 so as to slide in and out of bore 51 as the poppet goes up and down. Since the diaphragm 21 will flex in response to the amount of pressure in the pressure chamber 35 via the poppet valve, venting behind the diaphragm 21 is achieved by means of vents 52 and 53 so that air behind the relief valve may escape and return to atmosphere as the relief or poppet valve oscillates via the diaphragm 21. When the relief or poppet valve 45 is open, the pressure chamber 25 is exhausted via a relief chamber 54 defined between the opposing surfaces of the body partition 17 and the rear diaphragm 21. By further means of passageway 55 and chamber 56, the compressed gas is exhausted to atmosphere. The width of the passageways and vents is extremely critical to control noise and performance.

In view of the foregoing, it can be seen that the above described device provides a novel cycling system which uses a hammer 27 to create an internal impact which transmits the percussive blow via the applicator pad 12. This is safer for the patient than an externally free hammer. The actuating power is derived from the pneumatic introduction of compressed air to the pressure chamber 35 furnished by the supply hose 15. The flow of gas or air in the percussing frequency is controlled by the manual knob 16. As the knob opens the needle valve 40, compressed gas flows into the pressure chamber 35 between diaphragm 20 and the opposing wall surface of the partition 17. Sealing is effected by means of the diaphragm 20. This pressure strokes the hammer 27 against the impact spring 31 via flexing of the diaphragm 20. When the pressure in the chamber builds to 10 PSI, the relief valve 45 opens as pre-set by the spring 46. As soon as the pressure has opened against the small area of the round poppet valve 45, the high pressure gas flows into the rear or relief chamber 54 established between the diaphragm 21 and the opposing wall surface of the partition 17. Since the diaphragm area is much larger than the ball area, the valve and diaphragm assembly opens wide to allow all of the compressed gas to instantly escape through the exhaust passage 55. The area of the rear diaphragm is so large that this assembly is held open until the pressure in the combined chambers drops to 0.75 PSI. Thus, the internal chamber 35 oscillates between 10 and 0.75 PSI. When the relief valve 45 drops the pressure, the front impact spring 31 fires the hammer against the internal impact "O" ring 34. The internal impact is transmitted to the patient's chest wall by cover pad 12 when hard pressure is applied to the rear cover 13. This is the law of equal and opposite reactions.

In the use of the device, impact is imparted to partition 17 which is then transferred to the user via rear cover 13 and then by equal and opposite reaction to the patient. By employing the inventive impact device, the front cover or pad 12 never leaves or lifts from the skin of the patient. Therefore, the application of force is easier to control and particularly since the pneumatic device is small and lightweight.

While particular embodiments of the present invention have been shown and described, it will be obvious to those skilled in the art that changes and modifications may be made without departing from this invention in its broader aspects, and therefore, the aim in the appended claims is to cover all such changes and modifications as fall within the true spirit and scope of this invention.

What is claimed is:

1. A pneumatic percussive apparatus comprising the combination of:

a cylindrical body having a central bore;

a front and a rear diaphragm means coaxially disposed in said body central bore;

a partition disposed between said diaphragm means across said body central bore defining a pressure chamber and a relief chamber between its opposite sides or faces and an associated one of said diaphragm means;

means for pressuring said pressure chamber with a compressed gas so as to actuate said first diaphragm means;

valve means operably carried by said rear diaphragm means in cooperation with said body partition to relieve excessive pressure in said pressure chamber via said relief chamber by venting to atmosphere;

a weighted applicator pad secured to said front diaphragm means for imparting oscillatory impacting force via said partition and ultimately to a patient in response to cyclic changes of pressure in said pressure chamber;

said front diaphragm means includes a hammer carried on one side of said front diaphragm means and a front plate carried on the other side of said front diaphragm means;

an impact resilient ring carried on said partition;

an impact spring operably coupled to said first diaphragm means for urging said front diaphragm means including said hammer against said impact ring;

spring biasing means yieldably urging said valve means via said rear diaphragm means to close communication between said pressure chamber and said relief chamber;

a dome shaped, hand fitting cover carried on said body for covering said rear diaphragm means and said valve means; and silencing vent means in fluid communication with said relief chamber through said rear cover.

2. The invention as defined in claim 1 including:

guide means secured to said body for guiding said applicator pad in a linear, reciprocal movement with respect to said body in response to movement of said front diaphragm means.

3. The invention as defined in claim 2 which includes:

an elongated shaft extending between said front diaphragm means and said applicator pad via said guide means.

4. The invention as defined in claim 3 including:

needle valve means operably carried on said body for controlling the flow of said compressed gas into said pressure chamber to determine percussing frequency.

5. The invention as defined in claim 4 wherein:

said first mentioned valve means is a poppet valve which includes a valve seat provided about a central opening in said partition.

6. The invention as defined in claim 1 wherein:

said poppet valve and said rear diaphragm means constitute a relief valve cycling mechanism utilizing a change of areas to create oscillations.

7. The invention as defined in claim 6 including:

said applicator having a plastic-like rear cover means enclosing said rear diaphragm means and said applicator pad being composed of plastic-like material so as to be manipulated about the skin of the patient; and said applicator pad being rotatably carried on said front diaphragm means.

* * * * *